US005505323A

United States Patent [19]

Naoki et al.

[11] Patent Number: 5,505,323

[45] Date of Patent: Apr. 9, 1996

[54] CONTAINER CAPABLE OF BEING ASSEMBLED BY INTERLOCKING CONNECTIONS

[75] Inventors: Shinobu Naoki, Saitama; Tadashi Yoshida, Tokyo; Osamu Tominaga, Suzuka; Katsuji Kitahata, Sayama, all of Japan

[73] Assignee: Kabushiki Kaisha Steel Center, Tokyo, Japan

[21] Appl. No.: 312,716

[22] Filed: Sep. 27, 1994

[30] Foreign Application Priority Data

Oct. 1, 1993 [JP] Japan ..... 5-269791
Aug. 8, 1994 [JP] Japan ..... 6-205922

[51] Int. Cl.[6] ..... B65D 6/24

[52] U.S. Cl. ..... 220/4.28; 220/617

[58] Field of Search ..... 220/4.28, 4.29, 220/4.31, 4.32, 6, 666, 615, 616, 617, 618, 621, 1.5

[56] References Cited

U.S. PATENT DOCUMENTS 3,853,238 12/1974 Luisada et al. ..... 220/4.28
4,452,366 6/1984 Nagai et al. ..... 220/4.28
4,747,505 5/1988 Hansen ..... 220/4.28
4,776,484 10/1988 Hansen ..... 220/4.28
4,807,774 2/1989 Karpisek ..... 220/4.28

FOREIGN PATENT DOCUMENTS 404154583 5/1992 Japan ..... 220/4.28

*Primary Examiner*—Stephen J. Castellano
*Attorney, Agent, or Firm*—Hedman, Gibson & Costigan

[57] ABSTRACT

An interlocking male member is provided in a lower end portion of each side member. The interlocking male member has a projection extending beyond an outer surface of said side member and a bulge on its vertical wall which projects inwardly away from the projection. An interlocking female member is provided on an periphery of a bottom member to extend along at least portions thereof which correspond in position to the male members of the side members. The female member has a locking hole in which the projection of the male member is locked, and a recessed portion in which the bulges are locked. The side members are mounted to the bottom member in an upright position, by fitting the male members in the female member, while tiling the side members with respect to the bottom member, so that the projections are locked in the locking holes, and then rotating the side members toward the upright position so that the bulges are locked in the recessed portions.

4 Claims, 12 Drawing Sheets

CUTTING
31
32
33
34
35
36
37
38
39
40
41
42

CONTAINER CAPABLE OF BEING ASSEMBLED BY INTERLOCKING CONNECTIONS

BACKGROUND OF THE INVENTION

The present invention generally relates to containers for use in transportation of freight which are capable of being assembled by interlocking connections (hereinafter referred to as "interlockingly-assembled containers"), and more particularly to such an interlockingly-assembled container which is easy to assemble and dissemble by not requiring bolt-fastening connections and is particularly suitable for transportation of component parts and finished products of automobile, motor bike and the like.

When it is necessary to transport, as freight, parts or finished products of automobile or motor bike which are mostly not in the configuration of cube or rectangular parallelepiped, framework-shaped or box-shaped metallic packing containers are conventionally used.

As one form of the above-mentioned packing containers used for transporting automobile or motor bike, there are known packing frameworks which typically comprise a skid forming a bottom frame of the framework, a pair of front and rear end frames positioned on the front and rear ends of the skid, a pair of left and right side frames positioned on the left and right sides of the skid, and top frames interconnecting the front and rear end frames and the left and right side frames. In the past, such packing frameworks were assembled by fastening the parts together by means of bolts at a packing site.

However, since such packing frameworks have a number of bolt-fastening connections, they involve very complex and time-consuming assembly work.

For these reasons, there have been proposed various packing containers from which bolt-fastening connections are removed. For example, Japanese Utility Model Publication No. HEI 4-3953 discloses an interlockingly-assembled transporting container which, as shown in FIG. 15(*a*), comprises a supporting rail member 7 fixed to the upper edge of four peripheral sides of a bottom frame (not shown), and panel members 9 that are fitted into the rail member 7 to be fixed thereto in an erect or upright position. The supporting rail members 7 include an inner supporting wall 1, an outer locking wall 3 having a height smaller than the wall 1, and a bottom wall 2 continuously interconnecting the walls 1 and 3. (It should be noted that throughout this specification, the term" inner" refers to a "side facing the center of the bottom frame", while the term "outer" refers to a "side facing away from the center of the bottom frame".) The rail member 7 also has a gap provided between an imaginary slope 4 inclining outwardly in contact with at least the upper edge of the wall 1 and another imaginary slope 5 extending in parallel with the slope 4 in contact with at least a part of the locking wall 3. The supporting rail member 7 further has a locking space 6 between the locking wall 3 and the bottom wall. Each of the panel members 9 has at its underside a reinforcing portion 8 comprising a corrugated steel plate which is attached in such a manner that the steel plate is folded inwarly and then outwardly.

Further, Japanese Utility Model Laid-open Publication No. HEI 4-135421 discloses a container employing a metallic connecting structure which is intended for permitting easy assembly and dissembly of the container. The structure, as shown in FIG. 15(*b*), comprises a rail member including an outside member 11 having a J-shaped cross section, an inside member 12 having a substantially V-shaped cross section and secured to the inside surface of the higher-profile wall of the outside member 11 and a J-shaped-sectional member 13 secured to each panel member. The J-shaped-sectional member 13 has a straight portion continuously connecting to an arcuate-sectional portion. In assembly, the tip end of the arcuate-sectional portion 14 is abutted against the inside surface of a folded portion 15 formed near the distal end of the J-shaped-sectional member 13, and part of the arcuate-sectional portion is held in contact with the inside member 12.

However, of the above-mentioned two packing containers employing a bolt-free connecting structure, the former (i.e., the one disclosed in Japanese Utility Model Publication No. HEI 4-3953) has the problems that the supporting rail and the reinforcing portions of the panel members are fitted with each other in line contact, thus resulting poor connection strength, and that lateral displacement between the supporting rail and the reinforcing portions can not be avoided. With the latter (i.e., the one disclosed in Japanese Utility Model Laid-open Publication No. HEI 4-135421), the connecting structure requires a number of component parts, and it is difficult to determine the respective sizes of the individual component parts and the relative mounting positions of the parts, thus involving very troublesome operations to spot-weld the component parts in place. The latter-said container also can not prevent the relative lateral displacement between the parts.

SUMMERY OF THE INVENTION

It is therefore an object of the present invention to provide an interlockingly-assembled container which requires no bolt-fastening connections and hence can be assembled and dissembled with utmost ease, and which also allows its various component parts to be interconnected with sufficient strength to avoid lateral displacement between the component parts, and yet is easy to manufacture.

To achieve the above-mentioned object, an interlockingly-assembled container according to a first aspect of the present invention comprises a bottom member a plurality of side members, an interlocking male member provided in a lower end portion of each of the side members, the interlocking male member having a horizontal wall and a vertical wall, the horizontal wall having a projection extending outwardly beyond an outer surface of said side member, the vertical wall having, on an inner surface thereof, a bulge projecting inwardly away from the projection, and an interlocking female member provided on an periphery of the bottom member to extend along at least portions of the bottom member which correspond in position to the male members of the side members, the female member having a locking hole for locking therein the projection of the male member, the female member also having a recessed portion for locking therein the bulge of the male member, the side members being mounted to the bottom member in an upright position, by fitting the male members in the female member while placing the side members in a tilted position with respect to the bottom member and moving the side members toward the upright position so that the projections and bulges are interlocked with the locking holes and cavities, respectively.

An interlockingly-assembled container according to a second aspect of the present invention comprises a bottom member, a plurality of side members, an interlocking male member provided in a lower end portion of the side members, the interlocking male member having a rectangular cross section defined by inner and outer vertical walls and upper and lower horizontal walls, the upper and lower horizontal walls are greater in length than the inner and outer vertical walls when the side member is in an upright position, and an interlocking female member provided on an periphery of the bottom member to extend along at least portions of the bottom member which correspond in position to the male members of the side members, the female member having inner and outer vertical walls defining an upwardly-opening space in which the inner and outer vertical walls of the male members are inserted, the female member having, on inner and outer vertical walls thereof, bulges to permit rotation of the upper and lower horizontal walls of the male member and also having locking sections for lockingly engaging inner and outer and upper and lower surfaces of the male members, the side members being mounted to the bottom member in an upright position, by fitting the male members in the female member while placing the side members in a horizontal position, and moving the side members toward the upright position.

With the interlockingly-assembled container according to the first aspect of the invention, the interlocking male member, which is provided in a lower end portion of each of the side members, is composed of horizontal and vertical walls to assume an L-shaped cross section and has a projection extending outwardly beyond an outer surface of the side member and also a bulge that is formed on the inner surface of the vertical wall and projects inwardly away from the projection. Further, an interlocking female member is provided on the periphery of the bottom member to extend along at least such portions of the bottom member which correspond in position to the male members of the side members. The female member has locking holes for locking therein the projection of the male member provided on the side member, and also has a recessed portion for locking therein the bulge of the side member. In assembly, the side members are mounted to the bottom member in an upright position, by first fitting the male members in the mating female member provided on the bottom member, while placing the side members in a tilted position with respect to the bottom member, so that the projections on the respective horizontal walls of the male members are interlocked with the locking holes of the female member, and then moving the side members toward the upright position so that the bulges on the respective vertical walls of the male members are interlocked with the recessed portions of the female member.

With such arrangements, the bottom member and side members can be easily interconnected by only rotating the side members from an initial slightly-tilted position to the upright position, where, by the female member, the inner and outer and upper and lower surfaces of the male members are securely locked and lateral displacement of the male members are also prevented. Thus, it is possible to increase strength of interconnection between the bottom member and the side members and to substantially reduce the total number of component parts required.

In addition to the above-mentioned elements, a plurality of top corner connectors may further be provided for interconnecting the top corner sections of two adjoining side members as mounted to the bottom member in the upright position. Each of the corner connectors includes a pair of corner attachments respectively attached to the top corner sections of the adjoining side members. The two attachments have respective load supports positioned at different heights in such a manner that the bottom end of one of the supports abuts against the top end of the other of the supports to bear axial load of the corner sections. Each of the corner attachments has a connecting part integrally provided on an end portion thereof opposite to the top corner sections. Each of the corner connectors further includes a corner bracket having connecting parts provided on opposite ends thereof that are interlocked with the connecting parts of the corner attachments attached to the adjoining side members, and it also includes a section that is formed on an intermediate portion thereof for preventing interference with the supports. Thus, the top corner sections of the two adjoining side members can be easily interconnected without requiring any bolts, thereby making the assembly work of the container even easier.

With the interlockingly-assembled container according to the second aspect of the invention, the interlocking male member is provided in a lower end portion of each of the side members and has a height smaller than its width. The interlocking female member is provided on the periphery of the bottom member and has inner and outer walls defining upwardly-opening space in which the height of the male members is accommodated when the side members are placed in the horizontal position. The female member further has bulges, formed on the inner and outer vertical walls thereof, to permit rotation within the female member of the male members and also has locking sections for lockingly engaging the inner and outer and upper and lower surfaces of the male members. The side members and the bottom member can be interconnected by moving the side members, initially inserted in the bottom member in the horizontal position, toward the upright position. The locking engagement, by the female member, of the inner and outer and upper and lower surfaces of the male members each having a rectangular cross section achieves increased interconnection strength between the bottom member and the side members and substantial reduction in the total number of component parts required.

In addition to the above-mentioned elements, a plurality of top corner connectors may be provided for interconnecting the top corner sections of two adjoining side members as mounted to the bottom member in an upright position, by being fittedly pushed in the top corner sections. Each of said connectors has abutting portions and locking portions for locking therebetween the inner and outer and upper and lower surfaces of the two adjoining side members. With such arrangements, the top corner sections of the adjoining side members can be interconnected without using any bolts, thus making the assembly work of the container even easier.

Now, the preferred embodiments of the present invention will be described in detail with reference to the accompanying drawings.

DESCRIPTION OF THE PREFERRED EMBODIMENTS

Figure 1:
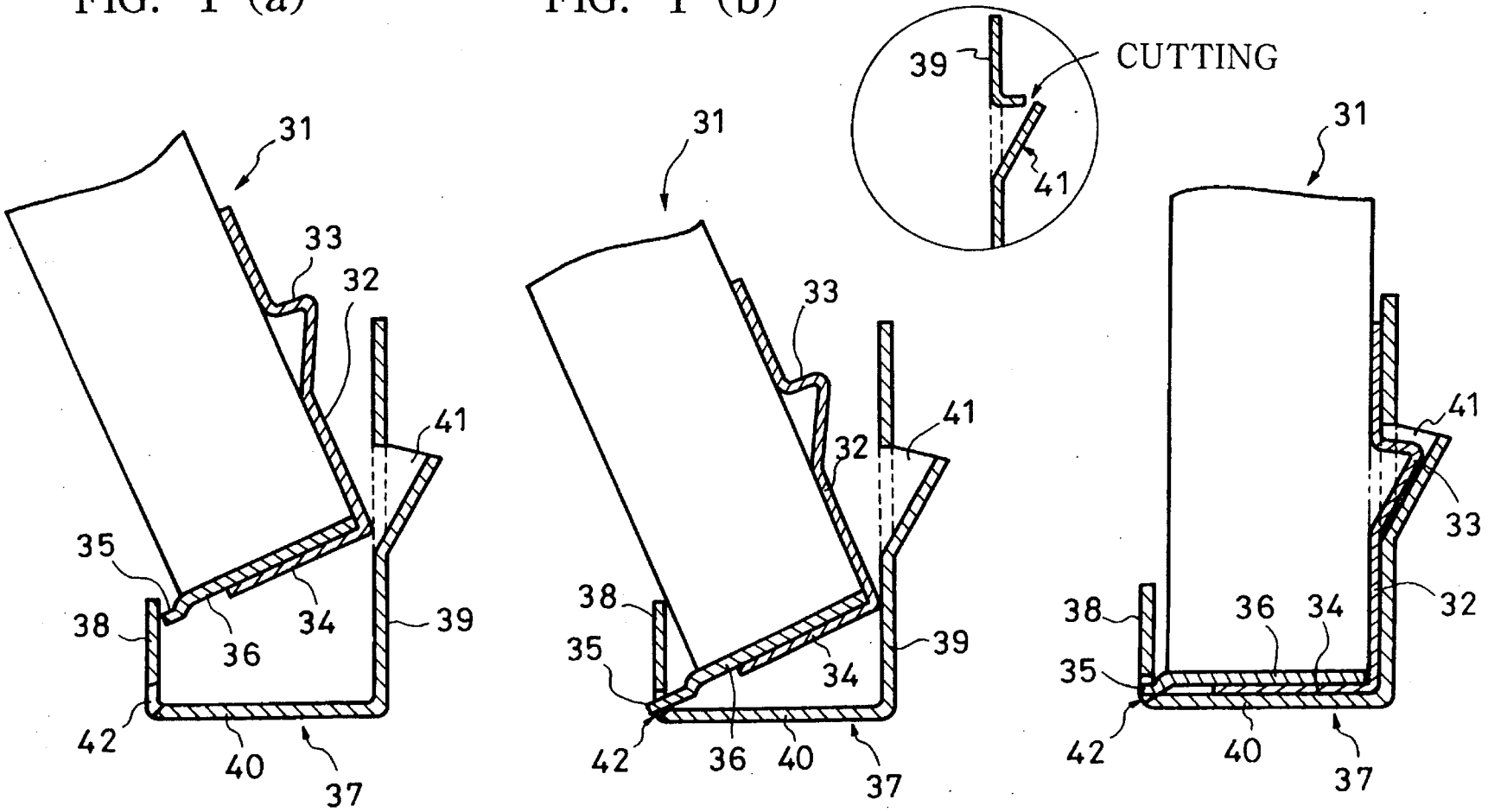
FIGS. 1(*a*) to 1(*c*) are views showing assembling steps by which a container according to a first embodiment of the present invention is brought into the assembled state with its component parts interlocked with each other.
Figure 2:
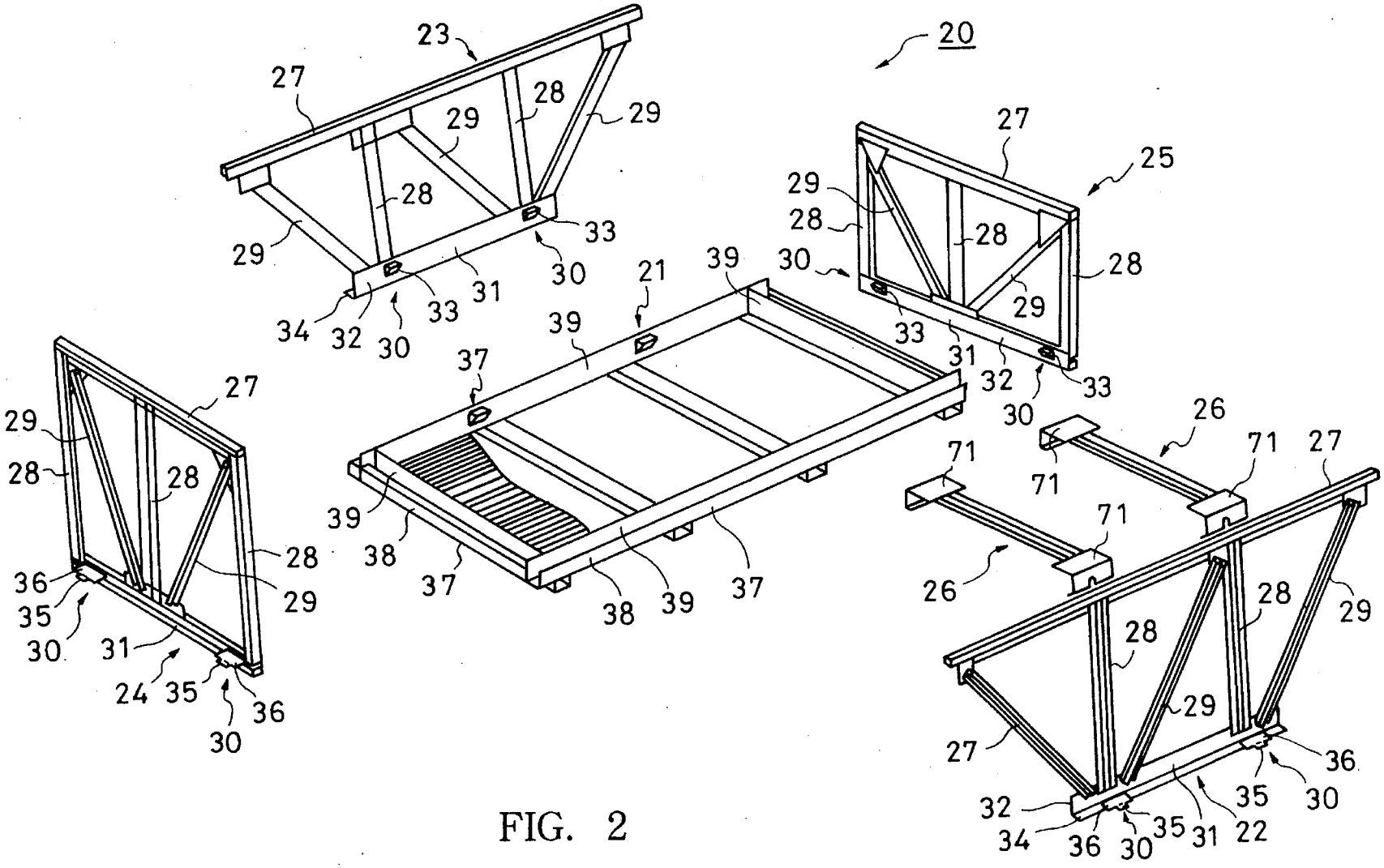
FIG. 2 is an exploded perspective view of the container according to the first embodiment.
Figure 3:
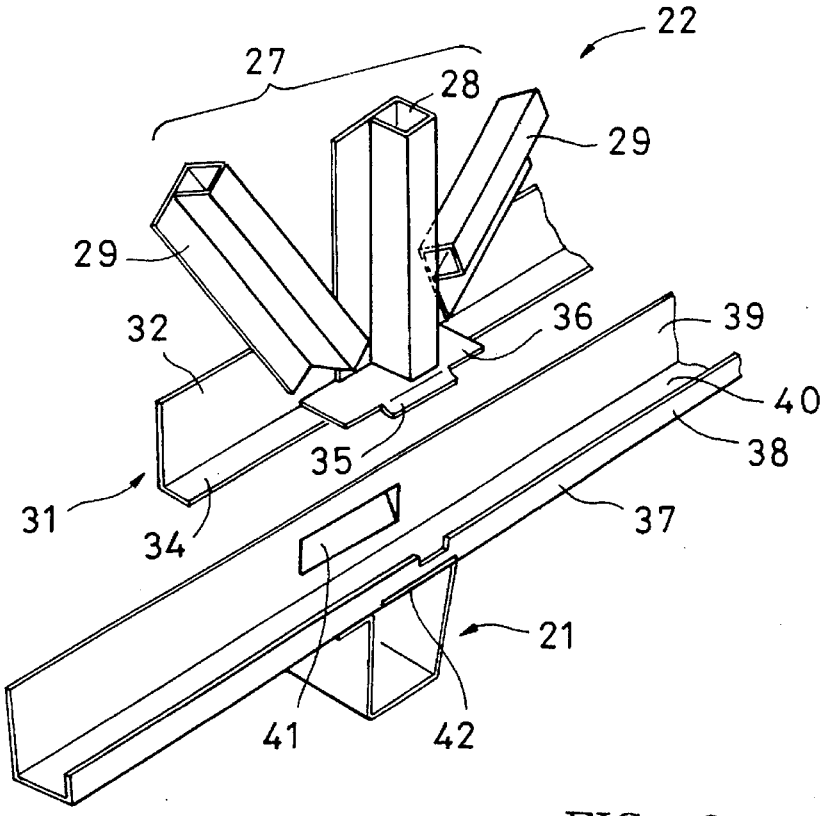
FIG. 3 is an exploded perspective view showing an interlocking connection between a bottom frame and an end frame of the container.
Figure 4:
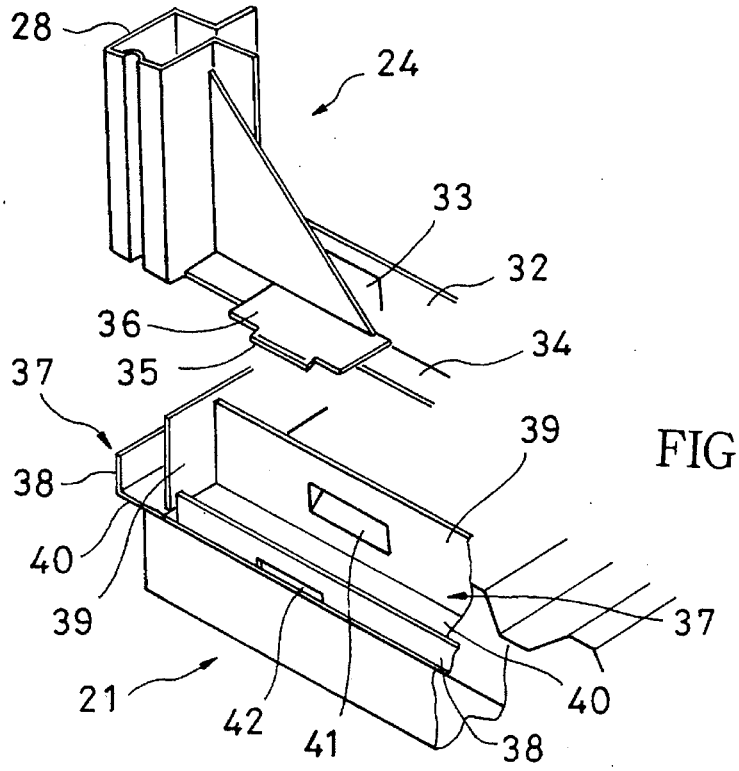
FIG. 4 is an exploded perspective view showing an interlocking connection between the bottom frame and a side frame in the container.
Figure 5:
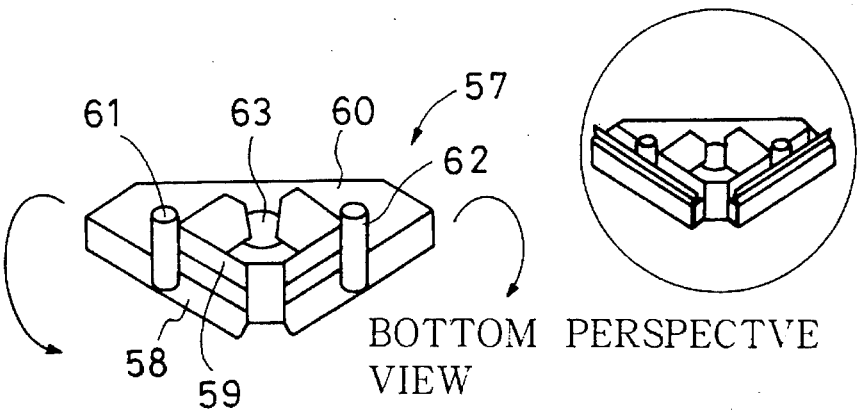
FIG. 5 is an exploded perspective view showing a top corner region of the container where an end frame and a side frame is connected with each other.
Figure 5:
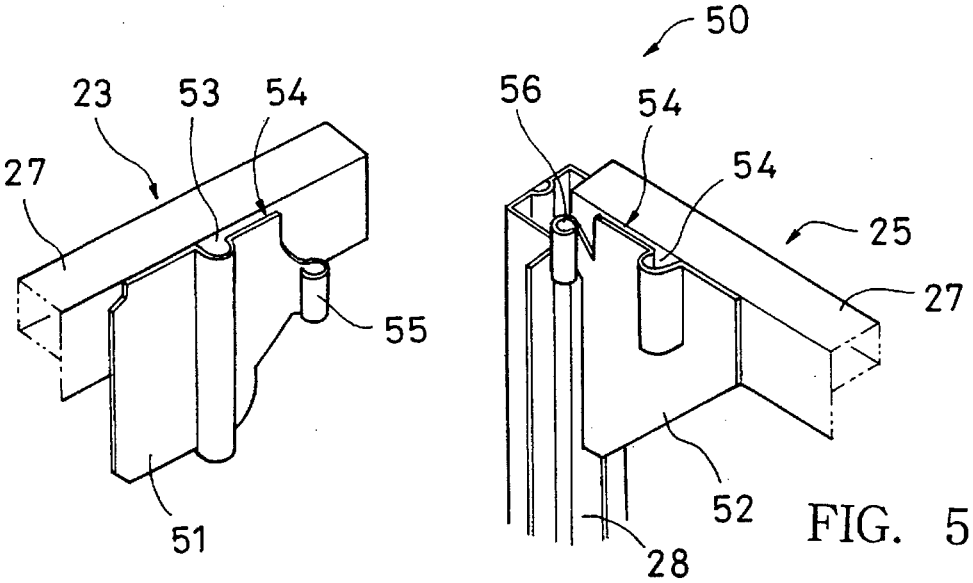
Figure 6:
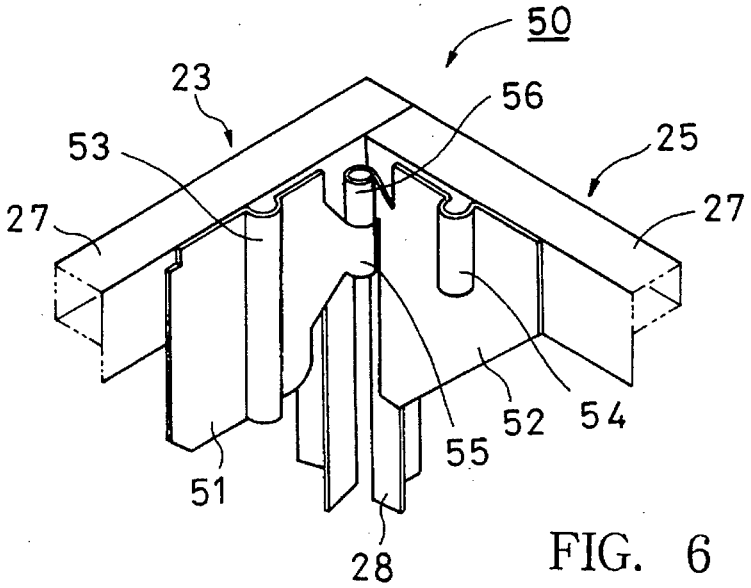
FIG. 6 is an exploded perspective view showing the assembled state of the top corner region shown in FIG. 5.
Figure 7:
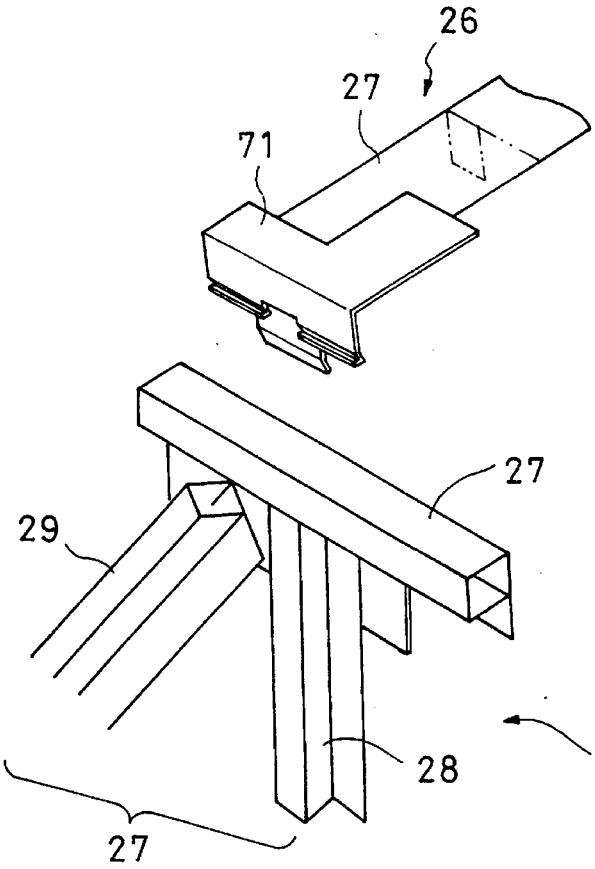
FIG. 7 is an exploded perspective view showing a portion of a top frame of the container.
Figure 8:
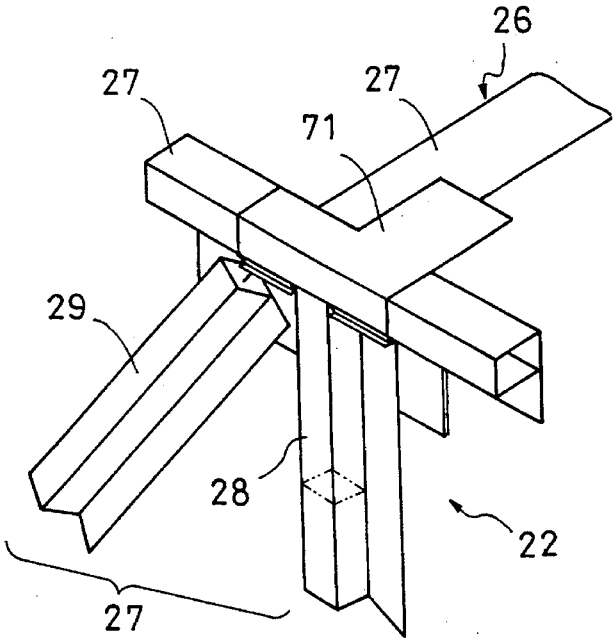
FIG. 8 is an exploded perspective view showing the assembled state of the portion of the top frame shown in FIG. 7.

FIGS. 1 to 8 are explanatory of an interlockingly-assembled container according to a first embodiment of the present invention, of which FIG. 1 is a view showing steps by which the container is brought into the assembled state with its component parts interlocked with each other, FIG. 2 is an exploded perspective view of the container, FIG. 3 is an exploded perspective view showing an interlocking connection between a bottom frame and an end frame in the container, FIG. 4 is an exploded perspective view showing an interlocking connection between the bottom frame and a side frame in the container, FIG. 5 is an exploded perspective view showing a top corner region of the container where an end frame and a side frame connect with each other, FIG. 6 is an exploded perspective view showing the assembled state of the top corner region shown in FIG. 5, FIG. 7 is an exploded perspective view showing a portion of a top frame of the container, and FIG. 8 is an exploded perspective view showing the assembled state of the portion of the top frame shown in FIG. 7.

As shown in FIG. 2, the interlockingly-assembled container according to the first embodiment is in the form of a panel-free packing framework 20 and comprises a skid 21 forming a bottom of the packing framework 20, a pair of front and rear end frames 22 and 23 positioned on the front and rear sides of the skid 21, a pair of left and right side frames 24 and 25 positioned on the left and right sides of the skid 21, and top frames 26 interconnecting the end frames 22 and 23. The front and rear end frames 22 and 23 and left and right side frames 24 and 25 all constitute side frames to be mounted on a later-described bottom frame of the skid 21, but the term "end frame" is used here for the front and rear side frames 22 and 23 to clearly distinguish from the left and right side frames 24 and 25.

The skid 21 forming the bottom of the packing framework 20 includes a rectangular peripheral bottom frame that is supported on four legs extending in the end-to-end (i.e., forward/rearward) direction, and a rectangular corrugated floor plate mounted within the bottom frame.

Each of the front and rear end frames 22 and 23, which are positioned on the front and rear sides of the base frame of the skid 21 and interconnected by the top frames 26, is made of hollow rod members 27 each having a substantially P-shaped cross section and is in a downwardly-narrowing trapezoidal shape that is formed by an upper frame member having the same length as the longitudinal length (i. e., the length in the leftward/rightward direction) of the rectangular base frame, a lower frame member shorter than the upper frame member so as to be positioned along the intermediate part of the base frame that has later-described connecting points, and vertical and oblique struts 28 and 29 interconnecting the upper and lower members.

Similarly, each of the side frames 24 and 25 which are positioned on the left and right sides of the base frame of the skid 21 is made of hollow rod members each having a cross section of a substantially P-shape or any other shape and is formed, by spot welding or the like, into a rectangular shape having the same length as the width (i.e., the length in the forward/rearward direction) of the rectangular base frame. The side frames 24, 25 are reinforced by vertical and oblique struts 28 and 29.

Further, according to the embodiment, the end frames 22 and 23, side frames 24 and 25 and skid 21 are capable of being assembled via interlocking connections 30 without requiring any bolt-fastening connections, as will be described in detail below.

The interlocking connections 30 provided in the end and side frames 22, 23 and 24, 25 have the same construction. As shown in FIGS. 1, 3 and 4, the lower frame member of the end frame 22 constitutes an interlocking male member 31 of an L-shaped cross section and interconnects the lower ends of the vertical struts 28, and two bulges 33 are formed, on the rear or inner (facing the center of the skid 21) surface of a vertical wall 32 of the male member 31, at two spaced-apart locations corresponding to the positions where the vertical struts 28 are fixed to the member 31, while two projections 35 are provided on a horizontal wall 34 to project beyond the outer surface of the side frame.

Each of the bulges 33 is integrally formed on the vertical wall 32 by press-drawing process and, as shown in FIG. 1, provides a hollow space having a section in the shape of a right-angled trianglular prism, with the upper surface of the bulge 33 extending at right angles to the general plane of the vertical wall 32. On the other hand, each of the projections 35, which project beyond the outer edge of the horizontal portion 34, is, as shown in FIG. 3, integrally formed on a separate plate 36 that is in turn secured to the horizontal wall 34 by spot-welding process or the like. As seen from FIG. 1, each of the projections 35 is bent from the remaining portion of the plate 36 in such a manner that it lies in the same horizontal plane as the horizontal wall 34 when the plate 36 is secured in place on the horizontal portion 34.

Similarly, in each of the side frames 24 and 25, the lower frame member constitutes an interlocking male member 31 having a L-shaped cross section, and two bulges 33 are formed, on the inner surface of a vertical wall 32 of the member 31, at two spaced-apart locations near the vertical struts 28 positioned on both ends of the frame 24 or 25, while two projections 35 are provided to project beyond the outer edge of a horizontal wall 34 of the member 31.

Each of the bulges 33 is integrally formed on the vertical wall 32 by press-drawing process and, as shown in FIG. 1, provides a hollow space having a section in the shape of a right-angled trianglular prism, with the upper surface of the bulge 33 extending at right angles to the general plane of the vertical wall 32. On the other hand, each of the projections 35 projecting beyond the outer edge of the horizontal wall 34 is, as shown in FIG. 3, integrally formed on a separate plate 36 that is secured to the horizontal wall 34 by spot-welding process or the like. As seen from FIG. 1, each of the projections 35 is bent from the remaining portion of the plate 36 in such a manner that it lies in the same horizontal plane as the horizontal wall 34 when the plate 36 is secured in place on the horizontal portion 34.

On the four-side periphery of the skid 21 are provided interlocking female members 37 that are brought to interlocking engagement with the above-mentioned interlocking male members 31 at predetermined locations.

As shown in FIGS. 1, 3 and 4, the female member 37 is composed of an outer vertical wall 38, an inner vertical wall 39 having a greater height than the outer vertical wall 38, and a horizontal wall 40 interconnecting the vertical walls 38 and 39. The inner vertical wall 39 has recessed portions, each of which is formed at such a position corresponding to the bulge 33 of the interlocking male member 31, by cutting and pressing outwardly a predetermined portion of the wall 39 so as to provide a space substantial 1y in the shape of a triangular prism complementary in shape to the bulge 33. In the lower end of the outer vertical wall 38 are formed locking hole or slits 42 that correspond in position and size to the projections 35 formed on the outer edge of the male member 31.

In the interlocking female member 37, the interval between the inner and outer vertical walls 38 and 39, i.e., the width of the horizontal wall 40 is determined in such a manner that the projections 35 and proximal corner of the male member 31 can be inserted into the female member 37 while the frame 22, 23, 24 or 25 is tilted outwardly. Further, the height of the recessed portions in the inner vertical wall 39 is determined in such a manner that the upper end surface of each bulge 33 of the male member 31 can be locked by the upper edge of the recessed portion when the male member 31 is placed in an erect position within the female member 37.

In addition, the height of the outer vertical wall 38 of the female member 37 is determined in such a manner that the corresponding end or side frame 22, 23, 24 or 25 will not be disturbed by the vertical wall 38 when inserted into the female member 37 while being tilted outwardly (see FIG. 1(*b*)).

As typically seen from FIGS. 2 to 4, the thus-constructed interlocking female members 37 are provided along the full length of the front and rear sides of the skid 21 where the end frames 22 and 23 are mounted, and are further provided along the left and right sides of the skid 21, where the side frames 24 and 25 are attached, between those female members 37 for the end frames 22 and 23.

As shown in FIGS. 1, 3 and 4, each of the end frames 22 and 23 and side frames 24 and 25 is mounted to the skid 21 by inserting the male member 31 between the inner and outer vertical walls 39 and 38 while the frame 22, 23, 24 or 25 is tilted outwardly by an angle of about 20 to 25 degrees (see FIG. 1(*a*)).

Then, the frame 22, 23, 24 or 25 is pushed downwardly into the female member 37 while being maintained in the tilted position, to cause the projections 35 on the horizontal wall 34 to be inserted in the corresponding locking slits 42 formed in the female member 37 (see FIG. 1(*b*)). At this time, the frame can be pushed into the female member 37 relatively smoothly because, as previously noted, the outer vertical wall 38 has a predetermined height not to disturb the frame 22, 23, 24 or 25.

As the frame is further pushed downwardly and angularly moved to an upright position, the bulges 33 of the male member 31 are fitted in, i.e., brought into locking engagement with the corresponding recessed portions 41 formed in the female member 37, and the projections 35 are also caused to be locked in the corresponding slits 42 in the female member 37. Now, the component parts have been interlocked.

After the male members 31 and female members 37 have been interlocked, relative displacement between the members 31 and 37 in the forward/rearward, lateral (leftward/rightward) and vertical (upward/downward) directions is prevented by the projections 35 of each male member 31 being locked in the locking slits and also by the bulges 33 being fitted in the recessed openings 41, so that the above-mentioned component parts are connected with each other firmly enough to not be displaced with each other in any directions.

Further, because the interlocking movement of such an interlocking connection 30 is started with the frame 22, 23, 24 or 25 slightly tilted by about 20 to 25 degrees, the initial insertion of the interlocking male member 31 can be done with ease. Thus, even a specially large container can be easily assembled in a short time even by a single person, requiring only a limited space for the assembly work.

Furthermore, because the male member 31 has high rigidity, it can be inserted in the female member 37 simply and yet reliably, and this also makes the assembly work even easier and less time-consuming.

Moreover, because a single interlocking connection between the male and female members 31 and 37 can prevent relative displacement in any directions between the male and female members 31 and 37, it is not necessary to provide a connecting mechanism throughout the periphery of the skid.

It should also be appreciated that each of the recessed portions 41 may, in stead of being provided by cutting and pressing the outer inner wall 39 of the female member 37 to form a triangular-prism shaped space, be provided by first pressing the vertical wall 39 to form an outward projecting overhang and then cutting the apex of the overhang as shown within a circle in FIG. 1(*b*), so that the top end of the bulge 33 will not directly contact the cut part of the wall to thereby substantially facilitate the interlocking assembly and dissemble of the container.

Next, a description will be made on interlocking connections 50 provided on the top corner region of the packing framework 20 for interconnecting the top corner sections of adjoining end and side frames 22 or 23 and 24 or 25.

In this interlocking connection 50, corner attachments 51 and 52 are respectively attached to the end frame 22 and side frame 24, as shown in FIG. 5.

Each of the corner attachments 51, 52 has on its intermediate portion a semi-cylinder-shaped recess 53, 54 with a slight gap formed between the attachment and the inner surface of the upper frame member of the corresponding frame. The corner attachments 51 and 52 also have cylinder-shaped load supporting protrusions 55 and 56 positioned at different heights, in such a manner that the upper end of the load supporting protrusion 55 for the end frame 22 is abutted against the lower end of the load supporting protrusion 56 for the side frame 24 to bear the axial load of the top corner region.

To interconnect the corner attachments 51 and 52, a corner bracket 57 is employed, whose underside is shown in perspective in FIG. 5.

This corner bracket 57 has an outer piece 58 that is generally L-shaped to be held in contact with the respective outer surfaces of the end and side frames 22 and 24, and an inside piece 59 that is held in contact with the respective inner surfaces of the load supporting protrusions 55 and 56. The outside and inside pieces 58 and 59 are secured to a substantially-triangular top piece 60 by welding or the like. Further, on the opposite ends of the inside piece 59, there are provided cylindrical connecting portions 61 and 62 that are fitted into the recesses 53 and 54 of the corner attachments 51 and 52, respectively.

In addition, on the upper surface of the top piece 60 is provided a semicylindrical positioning protrusion 63 that is advantageously used when a plurality of the packing frameworks are stacked one above another. The positioning protrusion 63 is integrally formed on the top piece 60 by press process.

To carry out coupling in this interlocking connection 50, the corner attachments 51 and 52 of the end and side frames 22 and 24 are first positioned so that the load supporting protrusions 55 and 56 are placed into end-to-end abutting engagement as shown in FIG. 6. Then, the corner bracket 57, after having been turned upside down from the position of FIG. 5, is placed over the end and side frames 22 and 24 in such a manner that the outside piece 58 is brought in contact with the outer surfaces of the frames 22 and 24 and that the inside piece 59 is received in the gaps formed between the end frame 22 and the corner attachment 52 and between the side frame 24 and the corner attachment 52. Subsequently, the corner bracket 57 is pushed downwardly to cause the cylindrical connecting portions 61 and 62 to be fitted in the recesses 53 and 54, respectively.

With the interlocking connection 50 thus arranged, it is allowed to effectively prevent the end and side frames 22 and 24 from falling inwardly or outwardly.

Further, in such a case where a plurality of the packing frameworks are s tacked one above another, the semicylindrical positioning protrusion 63 integrally formed on the top piece 60 of the corner bracket 57 can prevent displacement between the frameworks by being fitted in holes formed in the underside of the skid 21 near the four corners thereof.

Additionally, by bending the lower edge of the outside piece 58 into a dogleg shape as indicated in a circle of FIG. 5, lower corner edges of the end and side frames 22 and 24 can be locked by the thus-bent lower edge. In this manner, the corner bracket can even more firmly interconnect the frames 22 and 24, thus preventing the frames 22 and 24 from accidentally slipping off due to excessive vibration that may often occur during transportation of the container.

In the packing framework 20 according to the embodiment, the top frames 26 can also be attached without requiring bolts.

To this end, as will be clear from the dissembled and assembled states shown in FIGS. 7 and 8, the top frame 26 is made of a hollow rod member having a substantially P-shaped cross section and has a length enough to abut against the inner surface of the end frame 22. Further, the top frame 26 has, on its opposite ends (for simplicity, only one of the ends is representatively shown in FIG. 7), substantially L-shaped locking plates 71, each of which is placed against the upper and outer surfaces of the upper frame member of the end frame 22. Each of the locking plate 71 has a lower end formed into a dogleg shape to lockingly engage the underside of the upper frame member.

Thus, if the top frame 26 is mounted to cover the upper frame members of the end frames 22 and 23, the frames 22 and 23 are locked by the hollow rod 27 and locking plates 71 provided on the opposite ends of the hollow rod 27, and vertical displacement of the top frame 25 itself can also be prevented by engagement with the locking plates 71 and the frames 22 and 23.

With the packing framework 20 thus arranged, the end and side frames 22, 23 and 24, 25 can be securely fastened to the skid 21 without using any bolts. In addition, the packing framework 20 can be easily assembled by pushing the corner brackets 26 into the four top corner sections and fixing the top frames 26 in place on the end frames.

Further, when it is desired to dissemble the packing framework 20 to take out the packed goods therefrom, the framework 20 can be easily dissembled by only removing the top frames 26 and corner brackets 57 and tilting outwardly the end and side frames 22, 23 and 24, 25.

Furthermore, the end and side frames 22, 23 and 24 and 25 which are made of a hollow rod member of a substantially P-shape cross section have great strength and little possibility of bending and can be interlockingly coupled with utmost ease.

Moreover, because the interlocking connections 30 and 50 employed in the embodiment are only composed of the interlocking male and female members 81 and 37 or the corner brackets 57, the connections 30 and 50 only require a very small number of component parts and are therefore very easy to manufacture.

Furthermore, although, in the above-described embodiment, the interlocking male and female members are provided on the entire periphery of the bottom frame and end and side frames, one of the interlocking male and female members may be provided only on a part of the periphery of the bottom frame or end and side frames, or alternatively, both the interlocking male and female members may be provided only on a part of the periphery of the bottom frame or end and side frames.

Moreover, although the embodiment has been described only in relation to the panel-free packing framework, a panel may be mounted within each of the end and side frames, and each of the top frames as well may have a panel so as to also function as a cover of the assembled container.

In addition, although has been described above as made of metal, the interlocking male member may be made of other material such as synthetic resin.

Now, a second embodiment of the present invention will be described below with reference to FIGS. 9 to 14.

Figure 9:
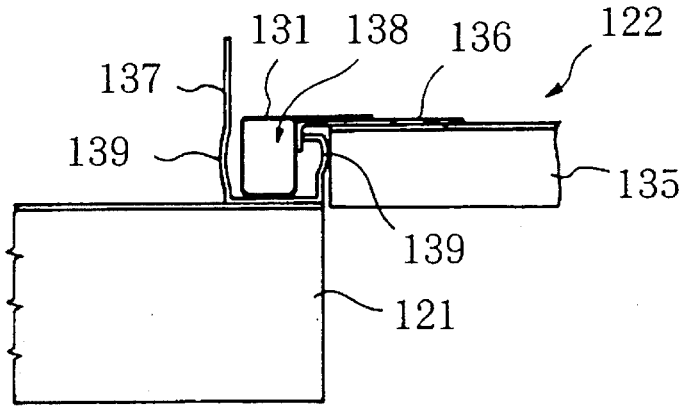
FIGS. 9(*a*) to 9(*c*) are views showing assembling steps by which a container according to a second embodiment of the present invention is brought into the assembled state with its component parts interlocked with each other.
Figure 9:
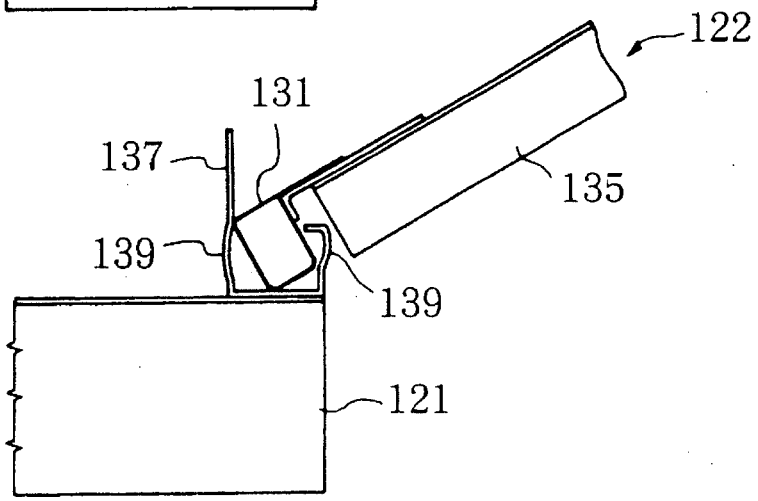
Figure 9:
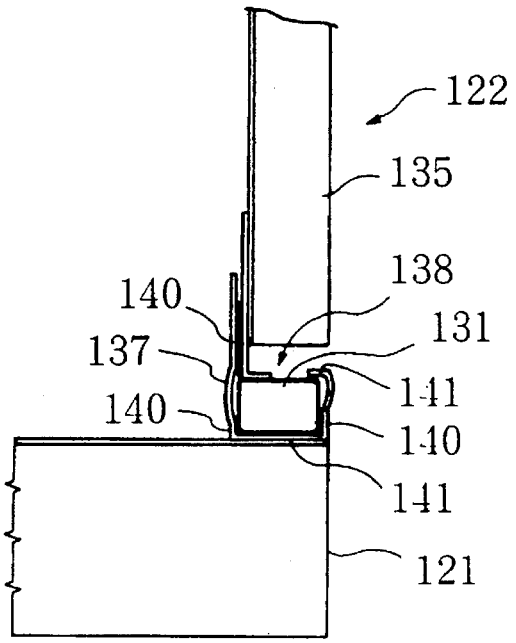
Figure 10:
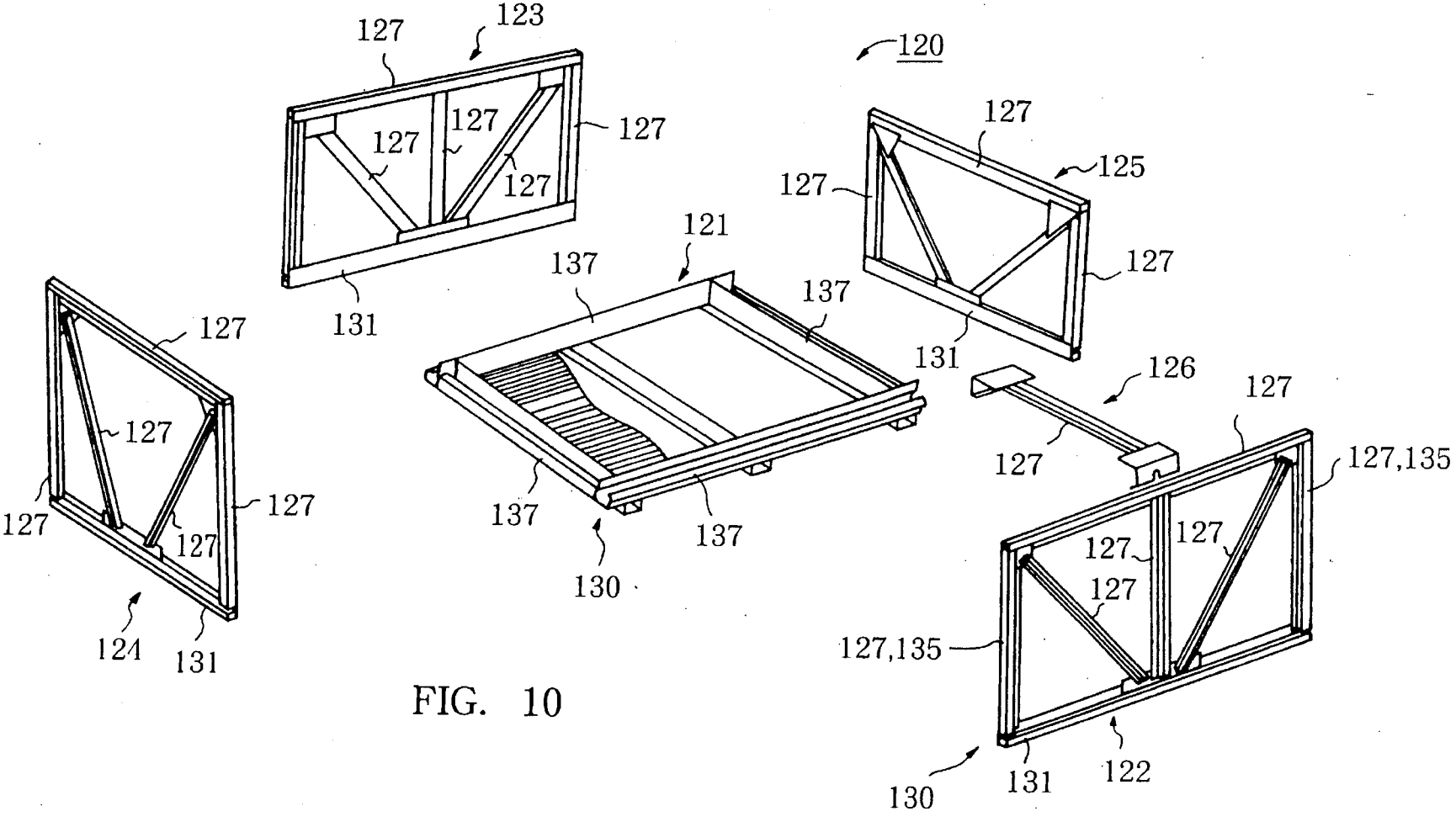
FIG. 10 is an exploded perspective view of the container according to the second embodiment.
Figure 11:
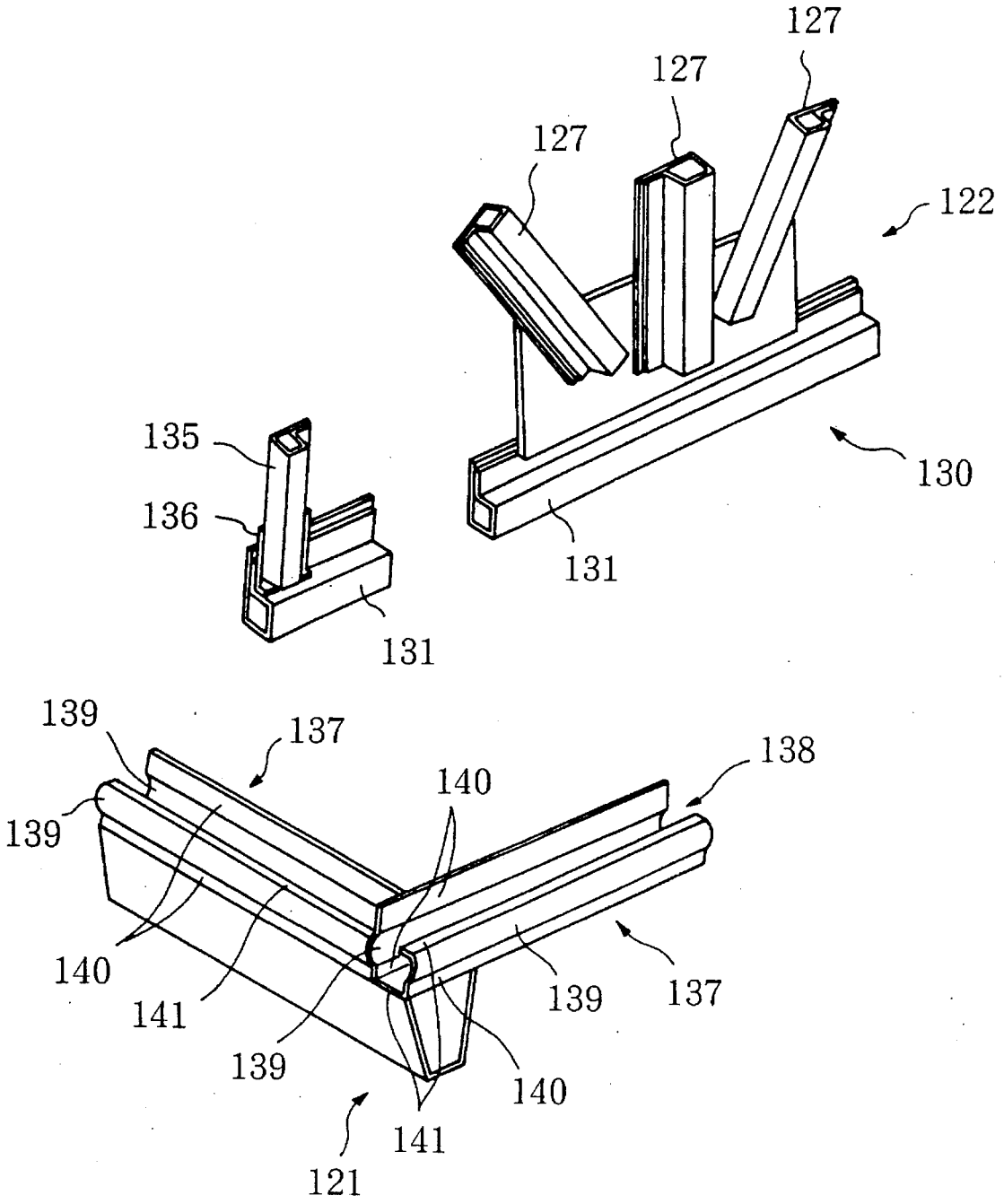
FIG. 11 is an exploded perspective showing an interlocking connection between a bottom frame and an end frame of the container according to the second embodiment.
Figure 12:
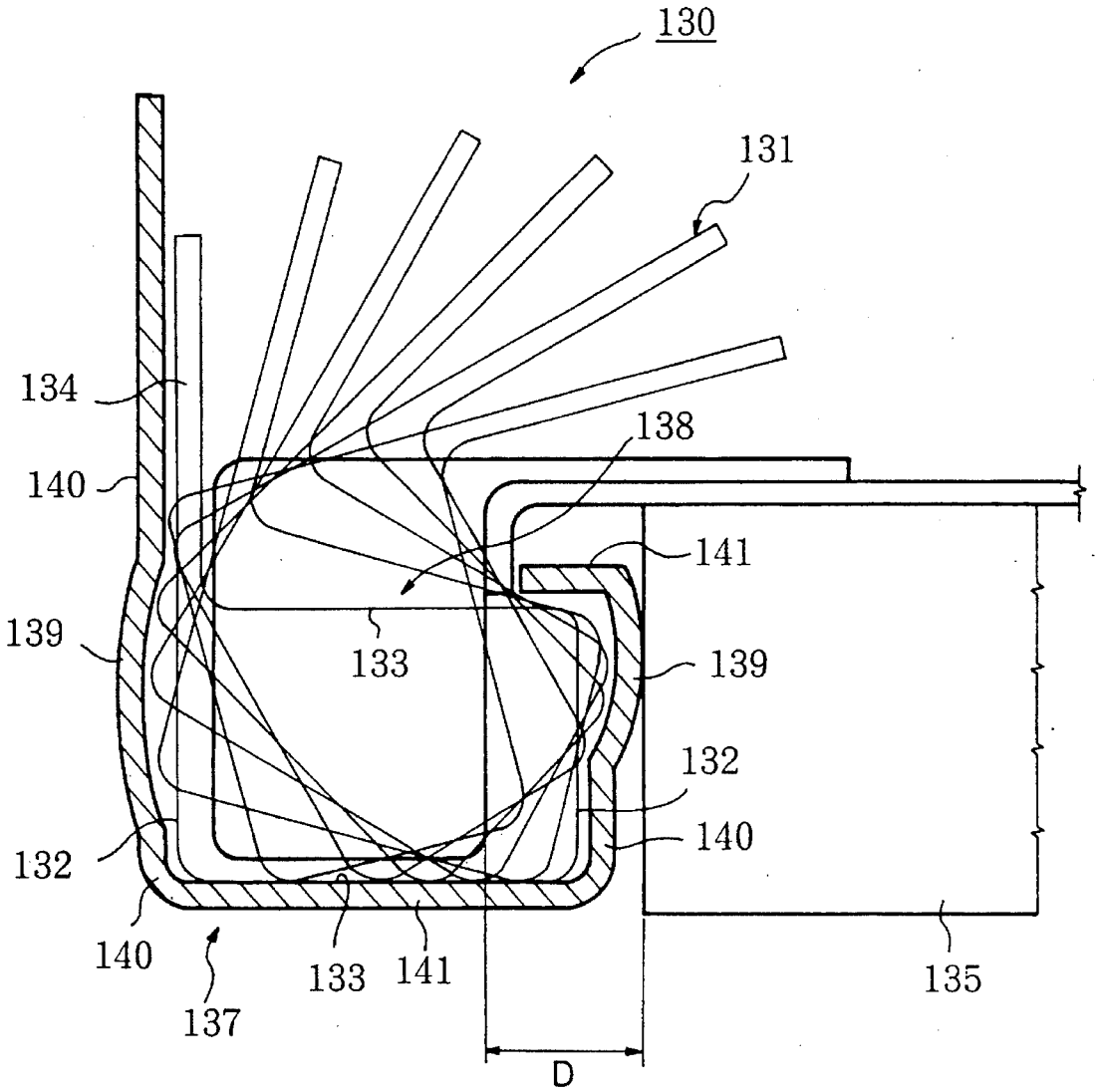
FIG. 12 is an enlarged sectional view of an interlocking connection in the container according to the second embodiment.
Figure 13:
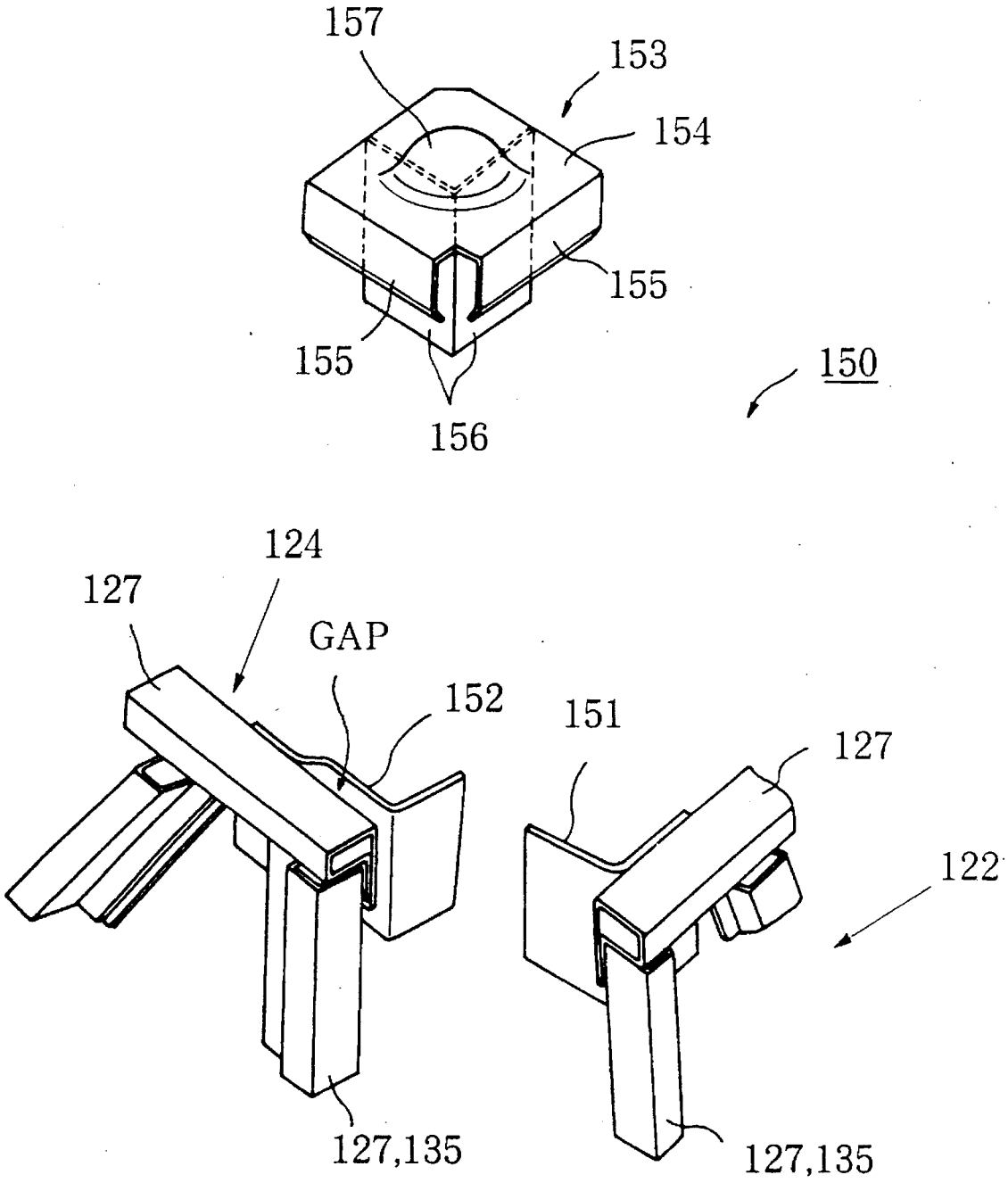
FIG. 13 is an exploded perspective view showing a top corner region of the container according to the second embodiment where an end frame and a side frame are connected with each other.
Figure 14:
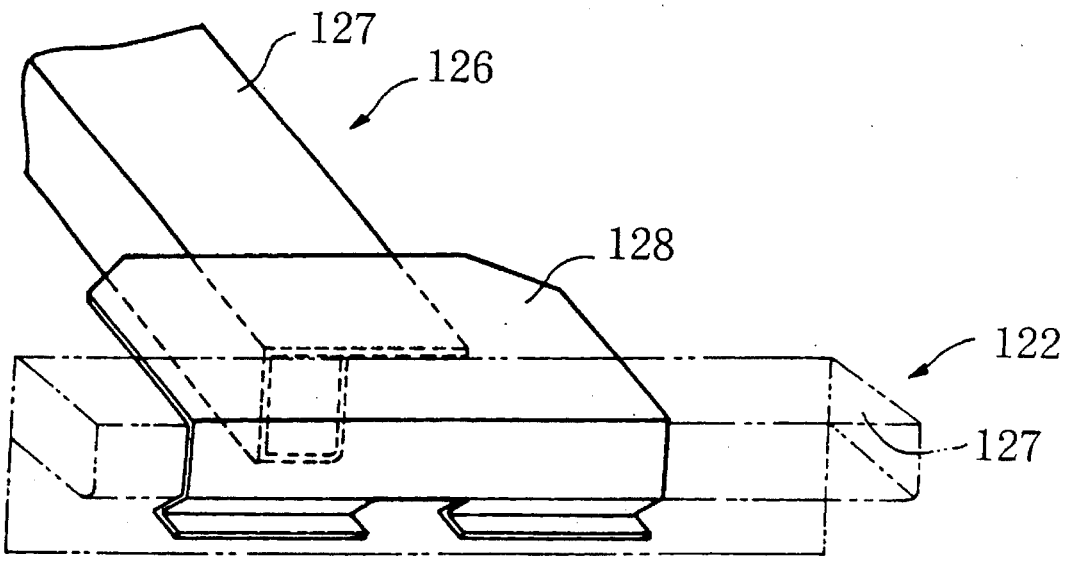
FIG. 14 is an exploded perspective view showing a top frame of the container according to the second embodiment.
Figure 15:
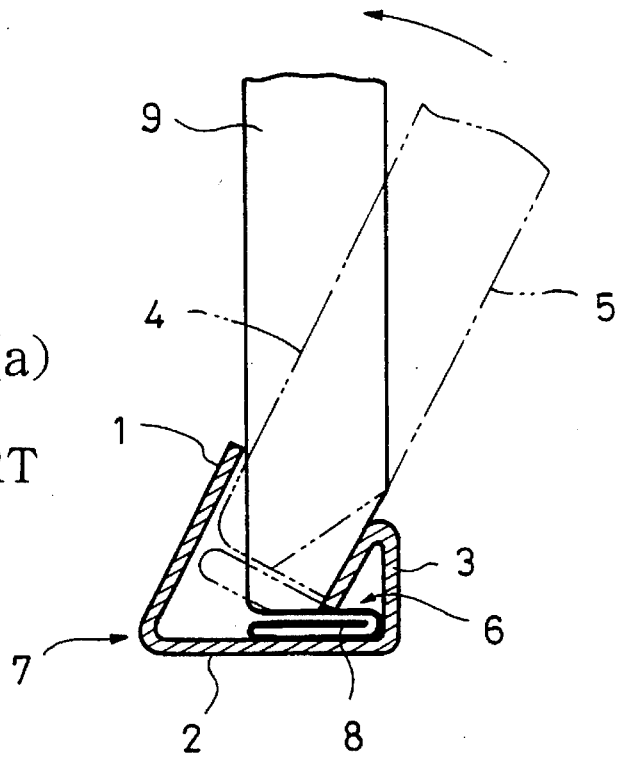
FIG. 15 (a) PRIOR ART
FIGS. 15(*a*) and 15(*b*) are sectional views explanatory of interlocking connections in prior art containers.
Figure 15:
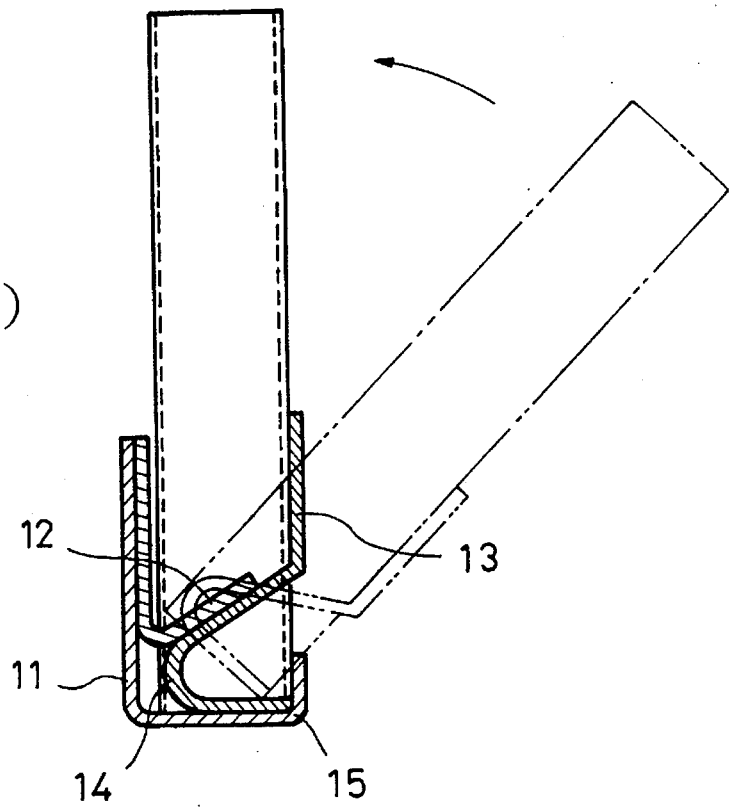
FIG. 15 (b) PRIOR ART

FIGS. 9 to 14 are explanatory of an interlockingly-assembled container according to a second embodiment of the invention of which FIG. 9 is a view showing steps by which the container according to the second embodiment is brought into the assembled state with its component parts interlocked with each other, FIG. 10 is an exploded perspective view of the container according to the second embodiment, FIG. 11 is an exploded perspective showing an interlocking connection between a bottom frame and an end frame of the container according to the second embodiment, FIG. 12 is an enlarged sectional view of an interlocking connection in the container according to the second embodiment, FIG. 13 is an exploded perspective view showing a top corner region of the container according to the second embodiment where the side frames connect with each other, and FIG. 14 is an exploded perspective view showing a top frame of the container according to the second embodiment.

As shown in FIG. 10, the interlockingly-assembled container according to the second embodiment is in the form of a panel-free packing framework 120 and comprises a skid 121 forming a bottom of the packing framework 120, a pair of end frames 122 and 123 positioned on the front and rear sides of the skid 121, a pair of side frames 124 and 125 positioned on the left and right sides of the skid 121, and a top frame 126 interconnecting the end frames 122 and 123. Each of the end and side frames 122, 123 and 124, 125 is made of a hollow rod member 127 having a substantially P-shape cross section and formed into a rectangular frame by spot welding or the like. The frame is reinforced by oblique struts.

According to the embodiment, these frames 122, 123, 124 and 125 and skid 121 are capable of being assembled by means of interlocking connections 130, without requiring any bolt-fastening connections.

The interlocking connections 130 for the end frames 122 and 123 and side frames 124 and 125 are of the same construction. As representatively shown in FIGS. 9, 11 and 12 in relation to the end frame 122, a lower frame member of the end frame 122 made of the hollow rod of P-shaped cross section is designed to also function as an interlocking male member 131. The male member 131 is shaped in such a manner that, when the end member 122 is in an complete upright position, inner and outer vertical walls 132 of the hollow end region are shorter in length than upper and lower horizontal walls 133 but wider than the walls 133. Further, the male member 131 is placed in an inverted P shape with the hollow end region positioned at the bottom and with a mounting portion 134 positioned in the inner side and is spot-welded to vertical struts 135 positioned on the opposite ends of the frame 122 with an interval D necessary for a later described interlocking assembly operation. Between each strut 135 and the male member 131 is interposed an L-Shaped reinforcing member 136 so as to disperse load applied.

Interlocking female members 137 which receive the male members 131 are provided on the four peripheral sides of the skid 121.

As shown in FIG. 12, the interlocking female member 137 has a modified P-shaped cross-sectional shape that is complementary to that of the interlocking male member 131 and has an opening 138 of a size enough for permitting insertion therein of the inner and outer vertical walls 132 so that the interlocking male member 131 can be fitted in the female member 137. Also, the interlocking female member 137 has, on its inner and outer walls, bulges swelling outwardly away from each other so that the interlocking male member 137 inserted in a horizontal position can be undisturbedly rotated to an upright position. Portions of the walls below the inner and outer bulges 139 have flat surfaces which provide inner and outer locking sections 140 for locking the opposite surfaces of the male member 131 in a sandwiching fashion. In addition, the upper end portion of the outer vertical wall of the female member 137 is bent inwardly to extend in parallel with the bottom surface of the opening which provides another locking section 141 for vertically locking the male member in a sandwiching fashion in cooperation with the bottom surface.

With the thus-constructed interlocking connection 130, the male member 131 is positioned along the lower edge of the end frame 122 and is fixed to the struts 135 on the opposite ends of the frame 122, leaving the interval D. On the other hand, the interlocking female member 137 is fixed to the side of the skid 121 where the end frame 122 should be mounted. Because of the presence of the interval D between the male member 131 and the struts 135, when the male member 131 is to be inserted in the female member 137, the vertical struts 135 will never interfere with the bulge 139 of the female member 137.

As typically shown in FIGS. 11 and 12, the interlocking female members 137 are attached to and along the full length of the front and rear ends of the skid 121 where the end frames 122 and 123 are attached, and are attached, between the female members 137 for the end frames 122 and 123, to the left and right sides of the skid 121 where the side frames 124 and 125 are attached. In corresponding relations to the thus-provided female members 137, the male members 131 are attached to and along the full length of the end frames 122 and 123 and are attached to the side frames 124 and 125 for a length shorter by the width of the female members 137 positioned on opposite ends of the frame.

As shown in FIGS. 9 and 12, to attach each of the frames 122, 123, 124 and 125 to the skid 121, the interlocking male member 131 is inserted in the mating female member 137 through the opening 138 while the frame is held in the horizontal position (FIG. 9(*a*)).

Then, the frame 122, 123, 124 or 125 is rotated toward the upright position (FIG. 9(*b*)). During this time, the bulges 139 formed on the female member 137 allows the frame to be smoothly rotated without interference.

When the frame 122, 123, 124 or 125 reaches the upright position, the male member 131 is completely fitted in, i.e., interlocked with the female member 137, and the assembly work is complete (FIG. 9(*c*)). With the male and female members thus interlocked with each other, the inner and outer surfaces and upper and lower surfaces of the male member 131 are tightly sandwiched or locked between the horizontal locking sections 140 and the vertical locking sections 141, respectively, so that secure connection can be achieved.

Because the interlocking movement of such an interlocking connection 130 is started with the side frame 122, 123, 124 or 125 held in the horizontal position, the initial insertion of the interlocking male member 131 in the female member 137 through the opening 138 can be done with ease. Thus, even a specially large container can be easily assembled even by a single person in a short time, although a somewhat greater space is required for the assembly work as compared to the prior art where the male member is inserted in the female member in an intermediate position between the horizontal and upright positions.

Further, because the male member 131 has high rigidity, i t can be inserted in the female member 137 simply and yet reliably, and this also makes the assembly work easier and less time-consuming.

Next, an interlocking connection 150 will be described which is provided on a top corner region of the packing framework 120 according to the second embodiment of the invention, with reference to FIG. 13.

In the case of this interlocking connection 150, an L-shaped positioning member 151 made of a metallic material is fixed to the upper end portion of one of the end and side frames 122 and 124, and a similar L-shaped positioning member of a metallic material is fixed to the upper end portion of the other of the end and side frames 122 and 124; in the illustrated example of FIG. 13, the positioning member 151 is fixed to the end frame 122, and the positioning member 152 is fixed to the side frame 124 with a gap for allowing insertion therein of the positioning member 151.

With the interlocking connection 150 thus constructed, after the positioning members 151 and 152 are attached as shown in FIG. 13, the side frames 124 and 125 are first mounted in the upright position and then the end frames 122 and 123 are rotated to the upright position, during which time a projecting portion of the positioning member 151 is inserted into the gap of the positioning member 152 attached to the side frame 124.

In this way, positioning of the top corner section of the framework 120 is done.

With this interlocking connection 150, a corner section pressing member 153 for maintaining the positioned s rate of the top corner section is further provided, which is fixed in place by being pushed from above.

More specifically, the pressing member 153 includes a rectangular contact plate 154 that is brought into contact with the upper surface of the upper frame members of the end and side frames 122 and 124. A pair of holding portions 155 are formed to extend continuously from two adjoining sides in a perpendicular direction there to so that the portions 155 are pressed against the outer surfaces of the upper frame members of the end and side frames 122 and 124. The distal ends of the holding portions 155 are bent inwardly to be able to lock the underside of the upper frame member. Also, to the underside of the contact plate 154 are secured a pair of abutting portions 156 which extend vertically downward at right angles to each other to be brought into abutting engagement with the inner surface of the end and side frames 122 and 124.

Thus, as the corner holding member 153 is pushed into the top corner section of the end and side frames 122 and 124 fixed in place by two positioning members 151 and 152, the abutting portions 156 are placed into abutting engagement with the positioning members 151 and 152 disposed on the inner surface of the upper frame members of the frames 122 and 124, while the holding portions 155 is placed into abutting engagement with the outer surface of the upper frame members. This causes the upper frame members of the end and side frames 122 and 124 to be locked in a sandwiched manner, so that the top corner sections of the end and side frames 122 and 124 are securely connected with each other.

On the upper surface of the contact plate 154 of the corner holding member 153 is formed a semi-spherical projection 157 that, when stacking the frameworks 120 one above the other, is brought into fitting engagement with one of the four corners at the bottom of the upper skid 121 so as to prevent relative displacement between the frameworks 120.

In the packing framework 120 according to the second embodiment, the top frame 126 can also be attached without requiring bolts.

To this end, the top frame 126 is made of a hollow rod member 127 having a substantially P-shaped cross section and has a length enough to abut against the inner surface of the end frame 122. Further, the top frame 26 has, on its opposite ends (for simplicity, only one of the ends is representatively shown in FIG. 14), substantially L-shaped locking plates 128, each of which is placed against the upper and outer surfaces of the upper frame member of the end frame 122. Each of the locking plate 128 has a lower end formed into a dogleg shape to lockingly engage the underside of the upper frame member.

Thus, as the top frame 126 is mounted to cover the upper frame members of the front and rear end frames 122 and 123, the frames 122 and 123 are locked by the hollow rod 127 and locking plates 126 provided on the opposite ends of the hollow rod 27, and vertical displacement of the top frame 126 itself can also be prevented by engagement with the locking plates 127 and the frames 122 and 123.

With the packing framework 120 thus arranged, the end and side frames 122, 123 and 124, 125 can be securely fastened to the skid 121 without using any bolts. In addition, the packing framework 120 can be easily assembled by pushing the corner holding members 152 into the four top corner sections and fixing the top frame 126 in place on the end frames.

Further, when it is desired to dissemble the packing framework 120 to take out the packed goods therefrom, the framework 120 can be easily dissembled by only removing the top frame 126 and corner holding member 153 and tilting outwardly the end and side frames 122, 123 and 124, 125.

Furthermore, the end and side frames 122, 123 and 124 and 125 which are each made of a hollow rod member of a substantially P-shape cross section have great strength and little possibility of bending and can be interlockingly coupled with utmost ease.

Moreover, because the interlocking connections 130 and 150 employed in the second embodiment are only composed of the interlocking male and female members 131 and 137 or the corner holding member 153, the connections 130 and 150 only require a very small number of component parts and are therefore very easy to manufacture.

Furthermore, although, in the above-described second embodiment, the interlocking male and female members are provided on the entire periphery of the floor member and end and side frames, one of the interlocking male and female members may be provided only on a part of the periphery of the floor member or end and side frames, or alternatively, both the interlocking male and female members may be provided only on a part of the periphery of the floor member or end and side frames.

Moreover, although the second embodiment has been described in relation to the panel-free packing framework, a panel may be mounted within each of the end and side frames, and the top frame as well may have a panel to also function as an upper cover of the assembled container.

In addition, although has been described above as made of metal, the interlocking male member may be made of other material such as resin or may be made of a solid rod rather than a hollow rod as described.

It is to be noted that the above-described embodiments are only for illustrative purposes and various modifications can be made to the individual elements without departing the scope of the invention.

With the interlockingly-assembled container according to the first aspect of the invention, the interlocking male member, which is provided on and along the lower edge of each of the side members, is composed of horizontal and vertical walls to assume an L-shaped cross section and has a projection extending outwardly beyond the outer edge of the horizontal wall and also a bulge that is formed on the inner surface of the vertical wall and projects outwardly away from the projection. Further, an interlocking female member is provided on the periphery of the bottom frame to extend along at least such portions of the bottom frame which correspond in position to the male members of the side members. The female member has locking holes for locking therein the projections of the male members provided on the side members, and also has recessed portions for locking therein the bulges of the side members. In assembly, the side members are mounted to the bottom frame in an upright position, by first fitting the male members in the mating female member provided on the bottom frame, while placing the side members in a tilted position with respect to the bottom frame, so that the projections on the respective horizontal walls of the male members are interlocked with the locking holes of the female member, and then moving the side members toward the upright position so that the bulges on the respective vertical walls of the male members are interlocked with the recessed portions of the female member.

With such arrangements, the bottom member and side members can be easily interconnected by only rotating the side members from a slightly-tilted position to the upright position, where by the female member, the inner and outer and upper and lower surfaces of the male members are securely held in place and lateral displacement of the male members are also prevented. Thus, it is possible to increase strength of interconnection between the bottom frame and the side members and to substantially reduce the total number of component parts required. The assembly of the container can also be done with ease.

In addition to the above-mentioned elements, a plurality of top corner connectors is further provided for interconnecting top corner sections of two adjoining side members as mounted to the bottom frame in the upright position, and each of the corner connectors includes a pair of corner attachments respectively attached to the top corner sections of the adjoining side members. The attachments are interconnected by a corner bracket. Thus, the top corner sections of two adjoining side members can be easily interconnected without requiring any bolts, thereby making the assembly work of the container even easier.

With the interlockingly-assembled container according to the second aspect of the invention, the interlocking male member is provided on and along the lower edge of each of the side members and has a height smaller than its width. The interlocking female member is provided on the periphery of the bottom frame and has an upwardly-opening space in which the height of the male members is accommodated when the side members are placed in the horizontal position. The female member further has bulges, formed on inner and outer vertical walls thereof, to permit rotation of the male members and also has locking sections for lockingly engaging inner and outer and upper and lower surfaces of the male members. The side members and the bottom frame can be interconnected by moving the side members, initially inserted in the bottom frame in the horizontal position, toward the upright position. The locking engagement, by the female member, of the inner and outer and upper and lower surfaces of the male members having a rectangular cross section achieves increased interconnection between the bottom frame and the side members and reduction in the number of component parts required.

In addition to the above-mentioned elements, a plurality of top corner connectors is further provided for interconnecting top corner sections of two adjoining side members as mounted to the bottom frame in an upright position, by being fitted in the top corner sections.

Each of the connectors has abutting portions and locking portions for locking therebetween the inner and outer and upper and lower surfaces of the two adjoining side members. Thus, the top corner sections of the adjoining side members can be interconnected without using any bolts, thus making the assembly work of the container even easier.

What is claimed:

1. An interlockingly-assembled container comprising:

a bottom member;

a plurality of side members;

an interlocking male member provided in a lower end portion of each of said side members, said interlocking male member having a horizontal wall and a vertical wall, said horizontal wall having a projection extending outwardly beyond an outer surface of said side member, said vertical wall having, on an inner surface thereof, a bulge projecting inwardly away from said projection; and an interlocking female member provided on an periphery of said bottom member to extend along at least portions of said bottom member which correspond in position to said male members of said side members, said female member having a locking hole for locking therein said projection of said male member, said female member also having a recessed portion for locking therein said bulge of said male member, said side members being mounted to said bottom member in an upright position, by fitting said male members in said female member while placing said side members in a tilted position with respect to said bottom member and moving said side members toward the upright position so that said projections and bulges are interlocked with said locking holes and recessed portions, respectively.

2. An interlockingly-assembled container as defined in claim 1 which further comprises a plurality of top corner connectors for interconnecting top corner sections of two adjoining said side members mounted to said bottom member in the upright position, each of said corner connectors including:

a pair of corner attachments respectively attached to said top corner sections of said adjoining side members and having a pair of load supports positioned at different heights in such a manner that a bottom end of one of said supports abuts against a top end of the other of said supports to bear axial load of the corner sections, each of said corner attachments having a connecting part integrally provided on an end portion of said attachment opposite to the top corner sections; and a corner bracket having connecting parts provided on opposite ends thereof that are interlocked with said connecting parts of said corner attachments attached to said adjoining side members, and having, on an intermediate portion thereof, a section for preventing interference with said supports.

3. An interlocking-assembled container comprising a bottom member;

a plurality of side members;

an interlocking male member provided in a lower end portion of each of said side members, said interlocking male member having a rectangular cross section defined by inner and outer vertical walls and upper and lower horizontal walls, said upper and lower horizontal walls being greater in length than said inner and outer vertical walls when said side member is in an upright position; and an interlocking female member provided on a periphery of said bottom member which corresponds in position to said male members of said side members, said female member having a bottom portion and inner and outer vertical walls defining an upwardly-opening space in which said inner and outer vertical walls of said male members are inserted, said female member having, on said inner and outer walls thereof, bulges to permit rotation of said upper and lower horizontal walls of said male member and portions below said bulges having flat surfaces and thereby constituting inner and outer locking sections for lockingly engaging an inner surface of said outer vertical wall of said male member in a sandwiching fashion when said side member is in an upright position, and said female member having an upper end portion of the outer vertical wall bent inwardly to extend in parallel with the bottom surface of the bottom portion of said female member, said inwardly bent upper end portion of the outer vertical wall and said bottom portion of said female member constituting upper and lower locking sections for lockingly engaging an upper surface of the lower horizontal wall of said male member in a sandwiching fashion when said side member is in an upright position, said side members being mounted to said bottom member in an upright position, by fitting said male members in said female member while placing said side members in a horizontal position with said upper end of said side member extending outwardly form said bottom member, and moving said side members toward the upright position.

4. An interlockingly-assembled container as defined in claim 3 which further comprises a plurality of top corner connectors for interconnecting top corner sections of two adjoining said side members mounted to said bottom member in an upright position, by being fitted in the top corner sections, and wherein each of said connectors has abutting portions held in abutting engagement with inner surfaces of said adjoining side members and also has locking portions for locking therebetween said adjoining side members.

* * * * *